US011454225B2

(12) United States Patent
Nagler

(10) Patent No.: US 11,454,225 B2
(45) Date of Patent: Sep. 27, 2022

(54) SINGLE MOTOR-DRIVEN DUAL PUMP DETACHMENT MONITORING ALGORITHM

(71) Applicant: Halliburton Energy Services, Inc., Houston, TX (US)

(72) Inventor: Andrew Nagler, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 203 days.

(21) Appl. No.: 16/861,906

(22) Filed: Apr. 29, 2020

(65) Prior Publication Data

US 2021/0340973 A1 Nov. 4, 2021

(51) Int. Cl.

| | |
|---|---|
| ***F04B 23/06*** | (2006.01) |
| ***F04B 49/06*** | (2006.01) |
| ***F04B 23/04*** | (2006.01) |
| ***F04B 49/20*** | (2006.01) |
| ***F04B 17/03*** | (2006.01) |
| ***F04B 49/02*** | (2006.01) |
| ***F04B 49/10*** | (2006.01) |
| ***F04B 51/00*** | (2006.01) |
| ***F04B 11/00*** | (2006.01) |

(52) U.S. Cl.

CPC ..... *F04B 23/06* (2013.01); *F04B 11/0058* (2013.01); *F04B 17/03* (2013.01); *F04B 23/04* (2013.01); *F04B 49/02* (2013.01); *F04B 49/06* (2013.01); *F04B 49/065* (2013.01); *F04B 49/10* (2013.01); *F04B 49/20* (2013.01); *F04B 51/00* (2013.01); *F04B 2203/0209* (2013.01)

(58) Field of Classification Search

CPC ..... F04B 49/065; F04B 11/0058; F04B 1/02; F04B 23/06; F04B 49/06; F04B 49/10; F04B 2203/0209; F04B 23/04; F04B 49/20; F04B 51/00; F04B 17/03; F04B 49/02

See application file for complete search history.

(56) References Cited

U.S. PATENT DOCUMENTS 4,699,570 A * 10/1987 Bohn ..... F04C 28/02 417/69
4,915,591 A * 4/1990 Funke ..... G01F 11/029 417/18
5,163,818 A * 11/1992 Betsill ..... F04B 35/04 417/18

(Continued)

FOREIGN PATENT DOCUMENTS

WO 2003106816 A1 12/2003

*Primary Examiner* — Peter J Bertheaud

(74) *Attorney, Agent, or Firm* — Conley Rose, P.C.; Rodney B. Carroll

(57) ABSTRACT

The disclosure provides a method for monitoring a pumping system, comprising measuring the speed of a motor of the pumping system, wherein the pumping system further comprises a first pump and a second pump, wherein a control system is configured to operate the pumping system; determining a timeout period, wherein the timeout period is dependent on the speed of the motor; measuring the speed of the first pump, the second pump, or both, wherein there is a hall-effect sensor coupled to each of the first pump and the second pump; determining a designated operating condition of the pumping system; and determining if the first pump, the second pump, or both are enabled to operate in relation to the designated operating condition.

18 Claims, 5 Drawing Sheets

(56) References Cited

U.S. PATENT DOCUMENTS

| | | | | |
|---|---|---|---|---|
| 5,259,731 | A * | 11/1993 | Dhindsa | F04B 49/065 417/63 |
| 6,149,403 | A | 11/2000 | Van Davelaar et al. | |
| 7,581,449 | B2 * | 9/2009 | Miller | F04B 51/00 73/744 |
| 8,353,676 | B2 | 1/2013 | Kallesoe | |
| 10,502,201 | B2 * | 12/2019 | Kusumba | F04B 49/065 |
| 2016/0208794 | A1 * | 7/2016 | Singh | F04B 51/00 |
| 2020/0072201 | A1 * | 3/2020 | Marica | F04B 23/06 |

* cited by examiner

SINGLE MOTOR-DRIVEN DUAL PUMP DETACHMENT MONITORING ALGORITHM

TECHNICAL FIELD OF THE INVENTION

The present disclosure relates generally to pumping operations and, more particularly, to systems and methods monitoring the use of a single motor-driven dual pump system with varying coupling configurations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

In general, a well site comprises a variety of equipment for well stimulation and servicing. Generally, a well site requires multiple pumps and each pump is associated with a separate power source. Safety features are in place to prevent damage of the pumps during operation. When a pump is decoupled from its power source, the safety features originally in place may not be applicable to the new configuration.

Figure 1:
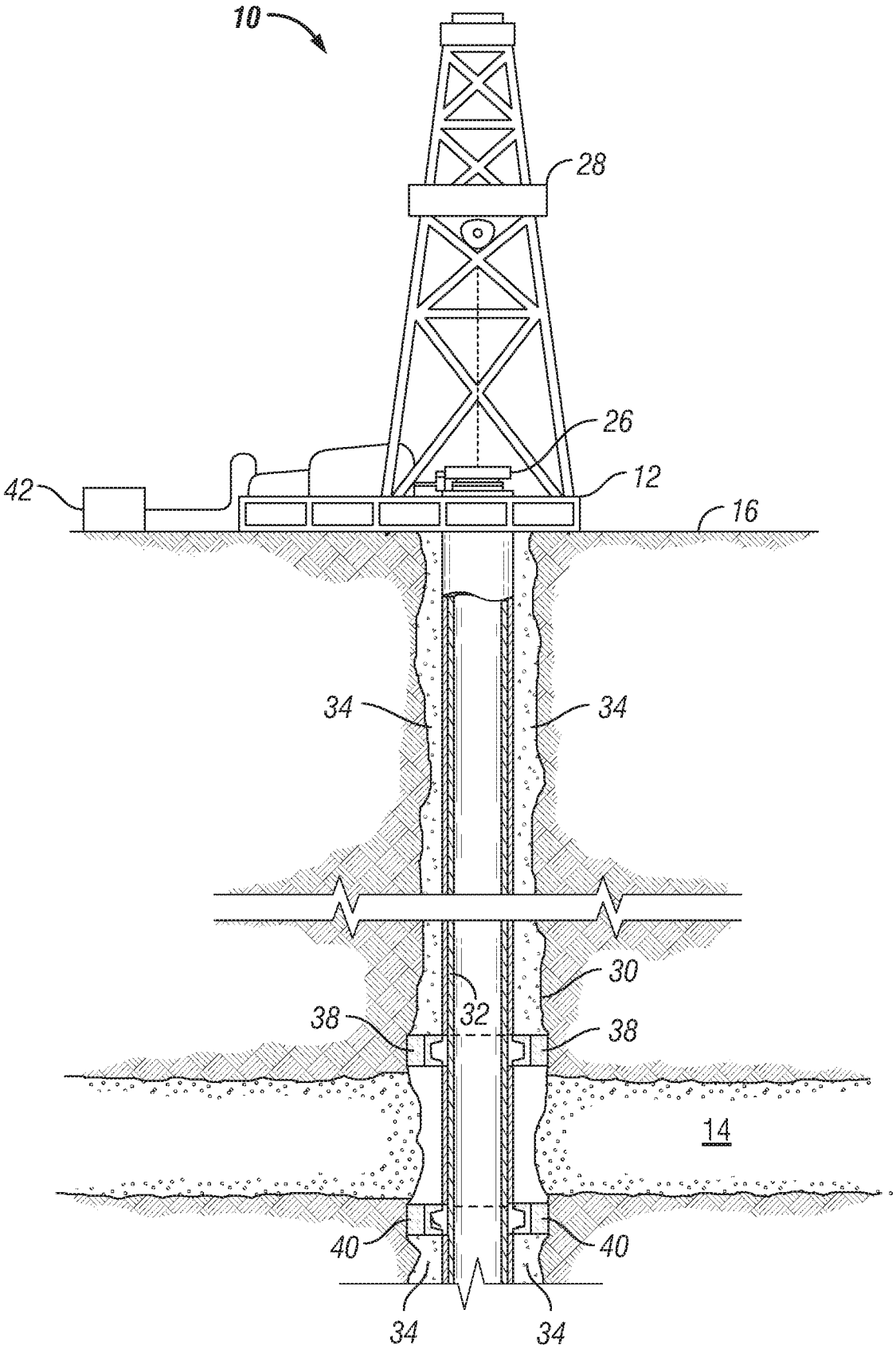
FIG. 1 is a schematic diagram of a well stimulation and servicing environment, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides for systems and methods for determining a discrepancy between the state of the mechanical coupling of two pumps to a singular output shaft of a motor and the operating condition of a pumping system. Any mismatch between these two can provide for reduced safety features, thereby resulting in damage to the pumping system and an increase in costs. The provided systems and methods may be able to detect the discrepancy and alert an operator in real-time.

FIG. 1 is a schematic diagram of a well stimulation and servicing environment 10. Generally, well stimulation and servicing environment 10 illustrates a system for transferring material from a surface-located hydrocarbon well site 12. The well site 12 may be located over a hydrocarbon bearing formation 14, which may be located below a ground surface 16. While well site 12 is illustrated at ground surface 16, the present disclosure contemplates any one or more embodiments implemented at a well site at any location, including, at sea above a subsea hydrocarbon bearing formation. At certain times during the management and operation of the well stimulation and servicing environment 10, the well site 12 may comprise a hoisting apparatus 26 and a derrick 28 for raising and lowering pipe strings such as a work string, drill string or any other mechanism for deploying downhole tools, such as a bottom hole assembly, a drill bit, sensors, or any other device or combination thereof.

The wellbore 30 may be formed through various earth strata including the formation 14. A pipe or casing 32 is insertable into the wellbore 30 and may be cemented within the wellbore 30 by cement 34. A first centralizer/packer device 38 may be located in the annulus between the well bore 30 and the casing 32 just above the formation 14, and a second centralizer/packer device 40 may be located in the annulus between the wellbore 30 and the casing 32 just below the formation 14. A pump system 42 according to one or more aspects of the present disclosure may be located at the well site 12. The pump system 42 may be configured to provide power for one or more pumps where the one or more pumps are configured to transfer, pump or flow material including but not limited to, water, linear gel, cross-linked gel, breaker, friction reducer, surfactant, biocide, sand, proppant, diverter, or any other stimulation fluid or any combination thereof.

Figure 2:
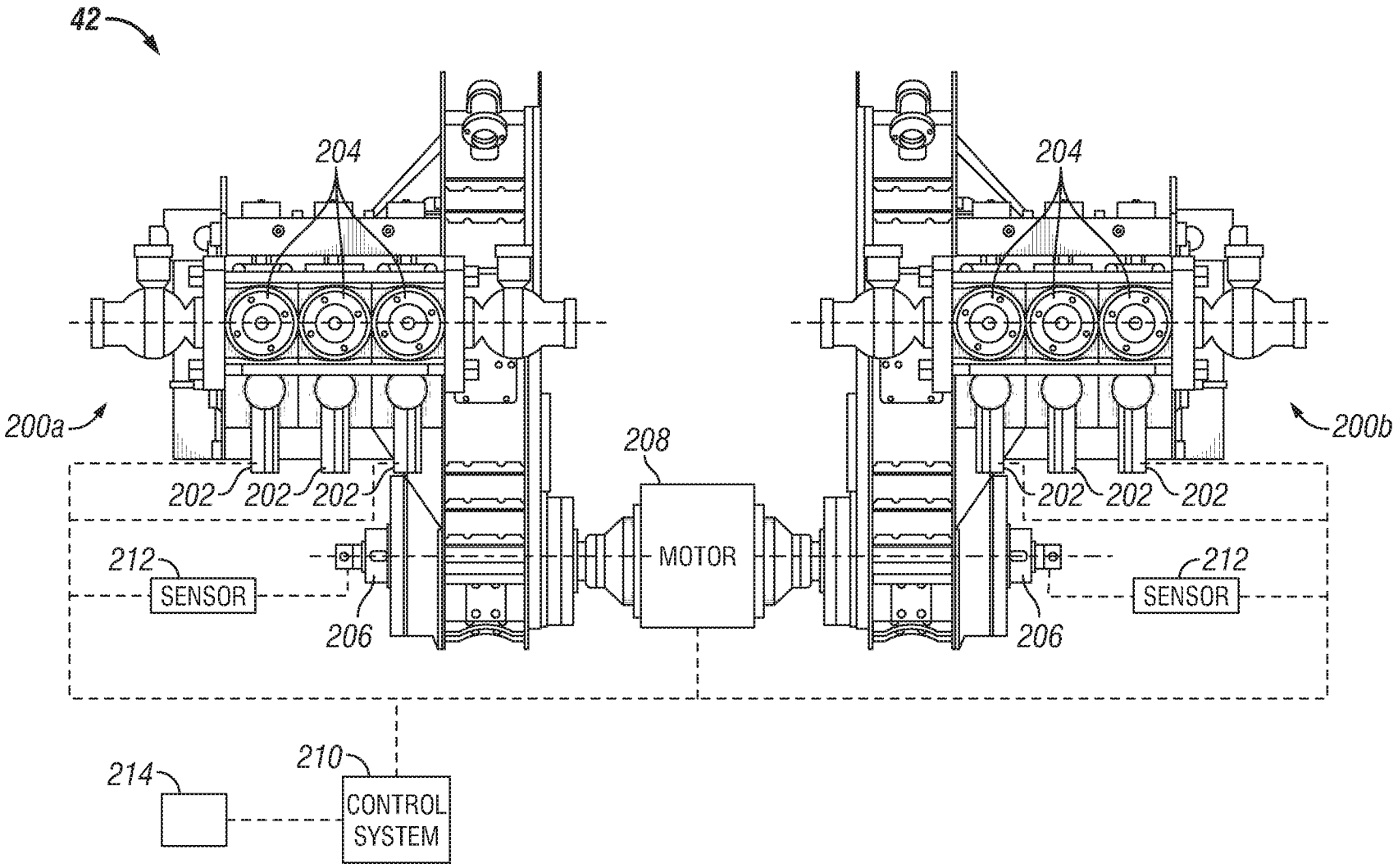
FIG. 2 is a front view of a pumping system, according to one or more aspects of the present disclosure.

FIG. 2 is a front view of the pump system 42, according to one or more aspects of the present disclosure. Pump system 42 may comprise a first pump 200*a* and a second pump 200*b* (collectively herein as "pumps 200"), for example, a positive displacement pump, with a valve system 202. In one or more embodiments, both first pump 200*a* and second pump 200*b* may be the same type and model. In other embodiments, the first pump 200*a* and the second pump 200*b* may be different types and/or models from each other. Each one of the pumps 200 may comprise multiple chambers 204 with plungers driven by a single crankshaft 206. By way of example only, pumps 200, as illustrated, may comprise three chambers 204 connected to a common crankshaft 206. For each chamber 204 of pump 200, the crankshaft 206 may drive a plunger (not shown) located within the chamber 204. The chamber 204 may include a suction valve (not shown) and a discharge valve (not shown). The suction valve connects a servicing fluid source to each one of the pumps 200. Pumps 200 may pressurize the servicing fluid and pump or discharge the servicing fluid via a flow line (not shown) to a desired location. Servicing fluid source may comprise any type of servicing fluid for any type of application. For example, in a well servicing application, a servicing fluid may comprise a well servicing fluid that may include, but is not limited to, any one or more of water, fracturing or stimulation fluid, mud, slurry, and any other fluid required to be pumped to a wellbore or downhole. The pumps 200 may be coupled to a motor 208 (or powertrain) that drives the crankshaft 206 for powering the pump 200. In one or more embodiments, the motor 208 comprises an electric motor. As illustrated, both the first pump 200*a* and second pump 200*b* may be coupled to the same motor 208.

The motor 208 may be coupled to a control system 210. Control system 210 may control the speed of the motor 208 and the actuation of the valve system 202. Control system 210 may be coupled to a sensor 212 that couples to one of the pumps 200 to measure one or more characteristics of that pump. In embodiments, the sensor 212 may be a hall-effect sensor configured to detect whether the pumps 200 are operating and/or the speed at which each of the pumps 200 is operating. In one or more embodiments, both the first pump 200*a* and the second pump 200*b* may be coupled to individual sensors 212 that may be coupled to the control system 210. In one or more embodiments, as one of the pumps 200 rotates, the sensor 212 may measure the nearby magnetic field, and the output voltage of the sensor 212 may be analyzed by the control system 210. In embodiments, a cycle may be determined by observing a rising edge and a falling edge from the output voltage. In these embodiments, each gear tooth may be equivalent to the number of rising edges. A timeout period may be defined herein as the period of time within which a rising edge should be received by the sensor 212. If a rising edge is not received within the timeout period, the control system 210 may determine that one of the pumps 200 is not rotating. In embodiments, the timeout period may be dependent on the revolutions per minute (rpm) of an output shaft of the motor 208.

$$\text{Signal Period(s)} = 60/(\text{motor RPM} * \text{Gear Reduction Ratio} * \text{number of gear teeth}) \quad (1)$$

$$\text{Timeout Period(s)} = \text{Signal Period} * \text{number of gear teeth} * \text{revolutions allowed} \quad (2)$$

Equations 1 and 2, as presented, may disclose how the timeout period may be calculated. In embodiments, the number of revolutions allowed may be an arbitrary value set for a tolerance. In embodiments, the pump system 42 may allow two revolutions of the shaft of the motor 208 before determining that one of the pumps 200 is inactive. In embodiments, the timeout period may accommodate for any lag in communications, inaccuracies in measurements, and any combination thereof.

In embodiments, a control selector switch 214 may be coupled to the control system 210. In one or more embodiments, the control selector switch 214 may be local to or remote from the control system 210. In embodiments, the control selector switch 214 may be configured to designate a specific operating condition and alternate between other options. For example, and without limitations, the operating conditions may be designated as "both pumps", "first pump", or "second pump". In embodiments, each operating condition may have certain safety features specific for that operating condition that must be satisfied prior to actuating the motor 208 to run. Without limitations, the safety features may include high-pressure pump output monitoring, lubrication system control, motor overcurrent protections, and any combinations thereof. During operations, an operator may manually actuate the control selector switch 214 and designate which of the operating conditions under which the pump system 42 should operate. In embodiments, if the operation of both pumps 200 is desired, then the control selector switch 214 may be actuated to rotate to select this option. In other embodiments, if the operation of only one of first pump 200*a* or second pump 200*b* is desired, then the control selector switch 214 may be actuated to rotate to select the option of either "first pump" or "second pump", respectively.

In one or more embodiments, control system 210 may comprise a controller such as, but not limited to, the CompactRIO, or any other suitable controller. In one or more embodiments, control system 210 may comprise any one or more information handling systems and may be directly or indirectly coupled to any one or more components of the pump system 42. In one or more embodiments, each of a plurality of control systems 210 may be communicatively coupled to each other and may be coupled to one or more different components of pump system 42. In one or more embodiments, control system 210 is located remotely from the pump system 42.

Figure 3:
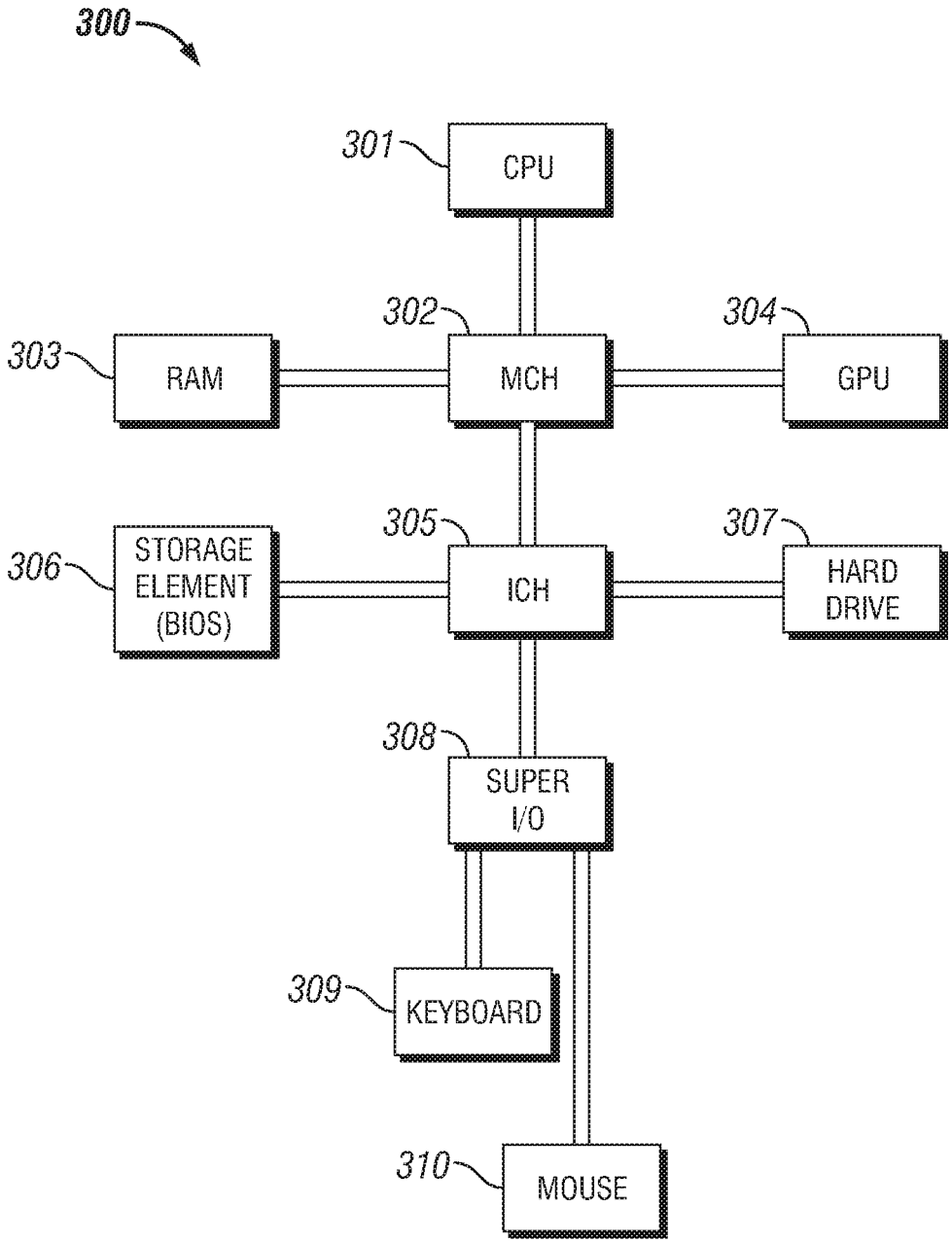
FIG. 3 is a diagram illustrating an example information handling system, according to aspects of the present disclosure.

FIG. 3 is a diagram illustrating an example information handling system 300, according to aspects of the present disclosure. The control system 210 (referring to FIG. 2) may take a form similar to the information handling system 300 or include one or more components of information handling system 300. A processor or central processing unit (CPU) 301 of the information handling system 300 is communicatively coupled to a memory controller hub or north bridge 302. The processor 301 may include, for example a microprocessor, microcontroller, digital signal processor (DSP), application specific integrated circuit (ASIC), or any other digital or analog circuitry configured to interpret and/or execute program instructions and/or process data. Processor 301 may be configured to interpret and/or execute program instructions or other data retrieved and stored in any memory such as memory 303 or hard drive 307. Program instructions or other data may constitute portions of a software or application for carrying out one or more methods described herein. Memory 303 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 303 for execution by processor 301.

Modifications, additions, or omissions may be made to FIG. 3 without departing from the scope of the present disclosure. For example, FIG. 3 shows a particular configuration of components of information handling system 300. However, any suitable configurations of components may be used. For example, components of information handling system 300 may be implemented either as physical or logical components. Furthermore, in some embodiments, functionality associated with components of information handling system 300 may be implemented in special purpose circuits or components. In other embodiments, functionality associated with components of information handling system 300 may be implemented in configurable general-purpose circuit or components. For example, components of information handling system 300 may be implemented by configured computer program instructions.

Memory controller hub (MCH) 302 may include a memory controller for directing information to or from various system memory components within the information handling system 300, such as memory 303, storage element 306, and hard drive 307. The memory controller hub 302 may be coupled to memory 303 and a graphics processing unit (GPU) 304. Memory controller hub 302 may also be coupled to an I/O controller hub (ICH) or south bridge 305. I/O controller hub 305 is coupled to storage elements of the information handling system 300, including a storage element 306, which may comprise a flash ROM that includes a basic input/output system (BIOS) of the computer system. I/O controller hub 305 is also coupled to the hard drive 307 of the information handling system 300. I/O controller hub 305 may also be coupled to a Super I/O chip 308, which is itself coupled to several of the I/O ports of the computer system, including keyboard 309 and mouse 310.

In certain embodiments, the control system 210 may comprise an information handling system 300 with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system 300 may also include one or more buses operable to transmit communications between the various hardware components.

Figure 4A:
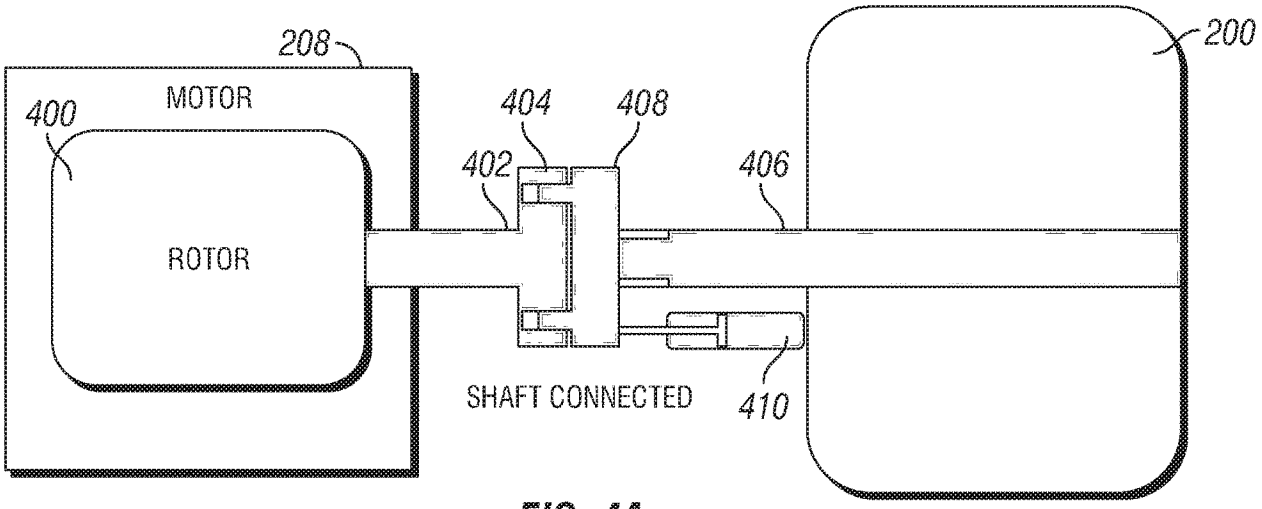
FIG. 4A is a diagram illustrating a disconnect for a pumping system, according to one or more aspects of the present disclosure.

FIG. 4A is a diagram illustrating a disconnect for a pumping system, according to one or more aspects of the present disclosure. In one or more embodiments, a rotor 400 of the motor 208 may be coupled to a drive shaft 402. Drive shaft 402 may comprise a drive shaft connector 404. The drive shaft 402 may be configured to drive a pump shaft 406 coupled to one of the pumps 200. Pump shaft 406 may comprise a pump shaft connector 408. Pump shaft connector 408 may be configured to engage with or otherwise releasably couple to drive shaft connector 404. A decoupler 410 may be coupled to the pump shaft connector 408. In one or more embodiments, there may be a separate decoupler 410 utilized for each of the first pump 200*a* (referring to FIG. 2) and second pump 200*b* (referring to FIG. 2).

Figure 4B:
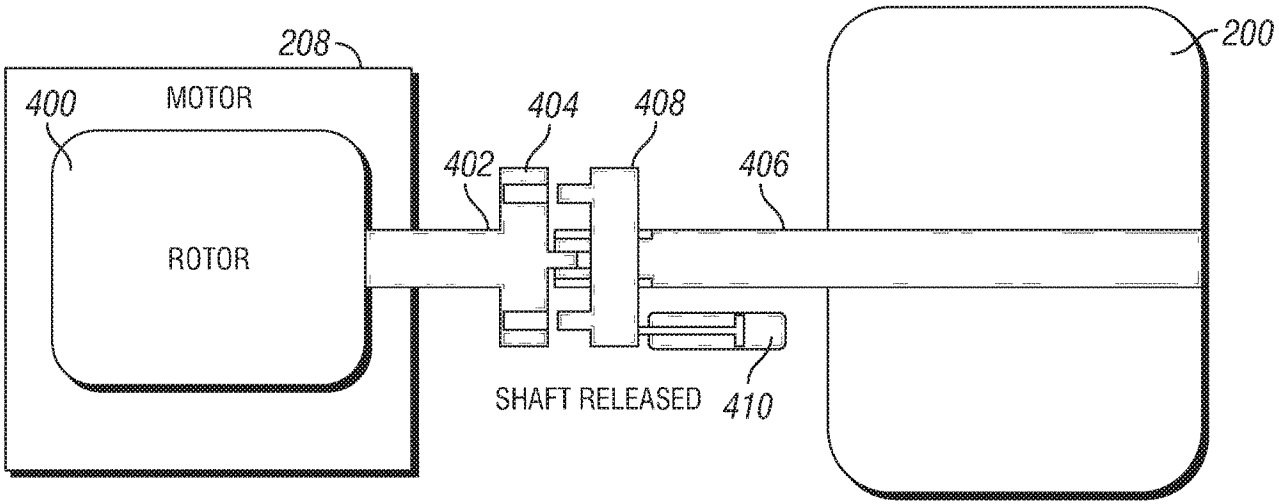
FIG. 4B is a diagram illustrating a disconnect for a pumping system, according to one or more aspects of the present disclosure.

When a power down sequence of the motor 208 is initiated or detected as discussed above, a hydraulic cylinder (for example, the primary component of decoupler 410) of the decoupler 410 may be actuated to disengage or disconnect the pump shaft connector 408 and pump shaft 406 from the drive shaft connector 404 and the drive shaft 402 as illustrated in FIG. 4B. The power down sequence may open the main breaker (not shown) supplying medium voltage power to a variable frequency drive (not shown), which may control the motor 208. In one or more embodiments, the decoupler 410 may be coupled to the control system 210 (referring to FIG. 2), and the control system 210 may activate the hydraulic cylinder (the primary component of the decoupler 410). In one or more embodiments, the decoupler 410 may be utilized in conjunction with an input control valve and an output control valve, as previously discussed herein (for example, suction valve and discharge valve). While the decoupler 410 is referenced herein to operate hydraulically, one of ordinary skill in the art will recognize that the decoupler 410 may operate using any suitable means to decouple the motor 208 from the pumps 200. Without limitations, the decoupler 410 may operate pneumatically, magnetically, via electrical power, via mechanical means (for example, with springs and fasteners), and any combinations thereof. In embodiments wherein the decoupler 410 operates via mechanical means, an operator may be required to manually actuate the decoupler. In these embodiments, there may not be feedback from the decoupler 410 to the control system 210 as they may not be coupled together, and the decoupler 410 may not operate with electrical power. In one or more embodiments, the decoupler 410 may disconnect one of the first pump 200*a* or the second pump 200*b* from the motor 208 if it detects overtorque from the motor 208. In embodiments, an operator may physically actuate the decoupler 410 to disconnect one of the first pump 200*a* or the second pump 200*b* from the motor 208.

In one or more embodiments, an operator may decouple one of the first pump 200*a* or the second pump 200*b* from the motor 208 and still run the remaining pump that is attached to the motor 208. During operations, the operator may perform a software disable of the pump that was decoupled, via the control system 210 (referring to FIG. 2), so as to remove the required safety features inherent in the designated operating condition for that pump. In one or more embodiments, the control system 210 may be configured to edit the safety features. In one or more embodiments, the safety features may prevent the pumps 200 and other equipment from being damaged. In certain embodiments where the safety features are not satisfied, the control system 210 may terminate operation of the pump system 42 (referring to FIG. 1). If the safety features are erroneously disabled for the first pump 200*a* and/or second pump 200*b* while that pump is still coupled to the motor 208, that pump may be operating improperly and/or inefficiently, thus resulting in damage. In the present embodiments, the control system 210 may be configured to detect any mismatch between whether the pumps 200 are coupled or decoupled from the motor 208 and the designated operating condition so as to maintain the correct safety features for a given configuration of the pump system 42. In one or more embodiments, the control system 210 may detect and adjust any potential mismatch for a given configuration of the pump system 42 when motor 208 is turning. In embodiments where the motor 208 is not turning, the control system 210 may not be required to perform this operation. In one or more embodiments, the pump system 42 may not need to be powered down due to any discrepancies while maintenance is performed on any auxiliaries of the pump system 42 without running the motor 208 (for example, lubricant oil monitoring).

Figure 5:
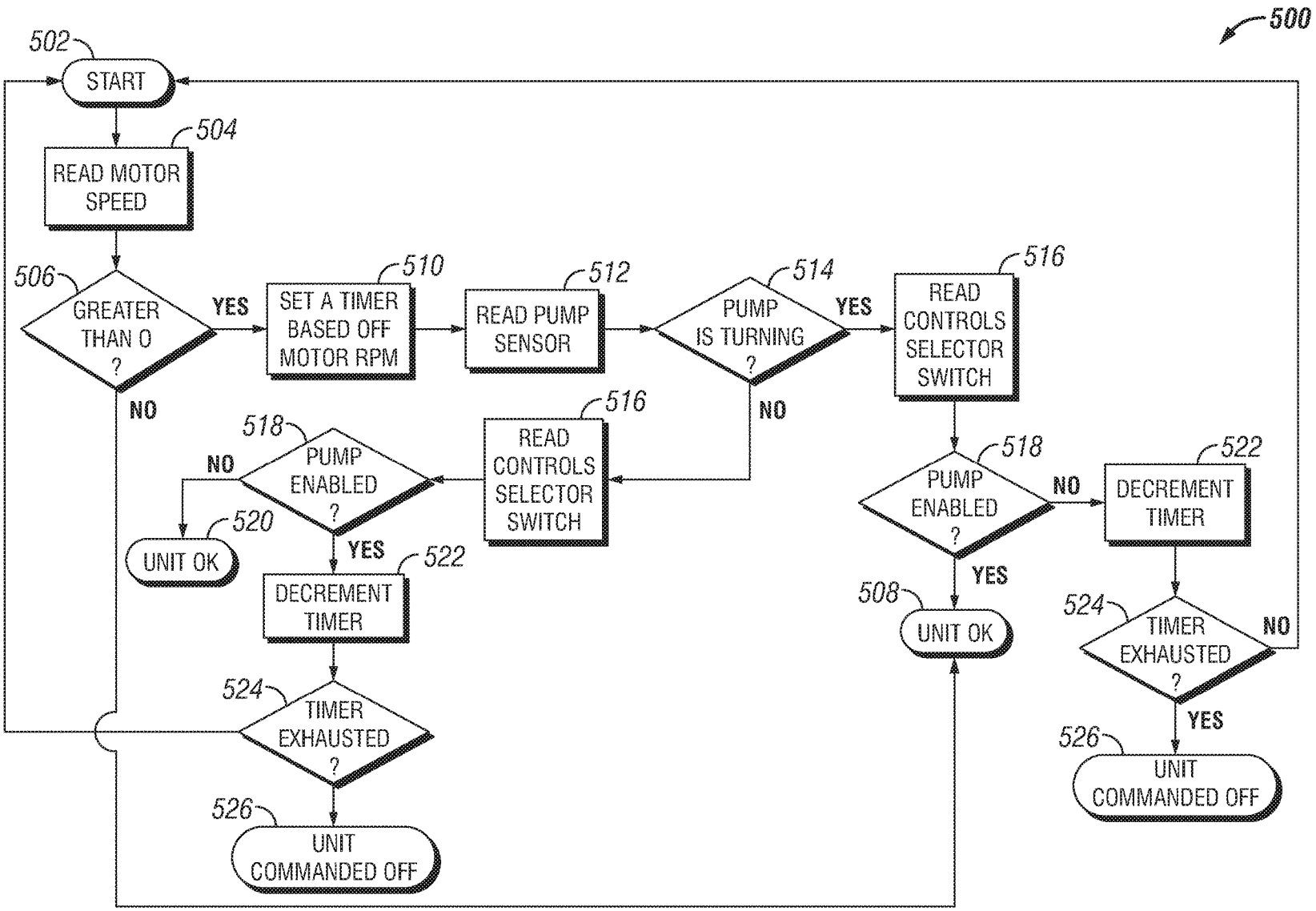
FIG. 5 is a diagram illustrating a method of operating a pumping system, according to aspects of the present disclosure.

FIG. 5 illustrates a method 500 of monitoring the performance of the pump system 42 (referring to FIG. 1). The method 500 may utilize the control system 210 (referring to FIG. 2) to detect and adjust an operating condition of the pump system 42 where there is a discrepancy between the coupling of both the first pump 200*a* (referring to FIG. 2) and the second pump 200*b* (referring to FIG. 2) to the motor 208 (referring to FIG. 2) and the designated operating condition selected by the control selector switch 214 (referring to FIG. 2) (for example, where the control selector switch 214 has selected the operating condition to be "both pumps" but only first pump 200*a* is coupled to the motor 208 after the second pump 200*b* has been decoupled). In an initial step 502, the control system 210 may be powered on or enabled to operate. The control system 210 may be configured to provide power to the motor 208 in order for the motor 208 to operate. In the initial step 502, the motor 208 may be actuated to operate and run at a predetermined speed. In a step 504, as the motor 208 is running, the control system 210 may measure the speed of the motor 208. Once a measurement is obtained, the control system 210 may determine whether or not the speed of the motor 208 is greater than zero in a decision step 506. If it is not greater than zero, then the method 500 ends at a conclusionary step 508 and any further operations at the well site 12 (referring to FIG. 1) may proceed.

If the speed of the motor 208 is greater than zero, then the control system 210 may initiate measuring time based off of the speed of the motor 208 in a step 510 to determine the timeout period, as previously disclosed above. In a step 512, both the sensor 212 (referring to FIG. 2) coupled the first pump 200*a* and the sensor 212 coupled to the second pump 200*b* may be actuated to measure the speed of each respective pump. In one or more embodiments, the control system 210 may be configured to provide power to the sensors 212 in order for the sensors 212 to operate. Once a measurement from the sensors 212 is obtained, the control system 210 may determine whether or not the first pump 200*a* and/or the second pump 200*b* is rotating in a decision step 514. Regardless of a determination of an affirmative or negative response, the method 500 may proceed to a step 516 wherein the control system 210 may compare the determination in decision step 514 with the designated operating status of the control selector switch 214 (for example, "both pumps", "first pump", "second pump", or "off"). In a step 518, a determination may be made by the control system 210 of whether or not the first pump 200*a* and/or the second pump 200*b* are enabled to operate according to the designated operating status. In embodiments, the first pump 200*a* may be enabled if the designated operating status is either "both pumps" or "first pump". In embodiments, the second pump 200*b* may be enabled if the designated operating status is either "both pumps" or "second pump".

In one or more embodiments, if the first pump 200*a* and/or second pump 200*b* is not rotating and is not enabled by being designated under the requisite operating status, then the pump system 42 may be operating satisfactorily, and the method 500 may terminate at a conclusionary step 520. In one or more embodiments, if the first pump 200*a* and/or second pump 200*b* is rotating and is enabled by being designated under the requisite operating status, then the pump system 42 may be operating satisfactorily, and the method 500 may terminate at conclusionary step 508. In embodiments, termination of the method 500 may allow for further operations to occur at the well site 12.

However, in the following embodiments, the method 500 may proceed to correct any mismatch between the coupling of the first pump 200*a* and/or the second pump 200*b* to the motor 208 and the designated operating condition selected by the control selector switch 214. In one or more embodiments, if the first pump 200*a* and/or second pump 200*b* is not rotating and is enabled by being designated under the requisite operating status, then the method may proceed to a step 522. Likewise, in embodiments where the first pump 200*a* and/or second pump 200*b* is rotating and is not enabled by being designated under the requisite operating status, then the method may proceed to step 522. In step 522, the control system 210 may decrement the measured time in the timeout period based off of the speed of the motor 208. A step 524 may proceed where there is a determination of whether or not the timeout period has been exhausted to determine whether or not there is rotation of the first pump 200*a* and/or second pump 200*b*. In embodiments where the measured time has not been exhausted, the method 500 may loop back to the beginning of the method 500 and repeat iterations until the measure time in the timeout period has been exhausted. In embodiments, there may be feedback into the method 500 until the timeout period has terminated or if a rising edge has been measured within the timeout period. In embodiments, where the measured time has been exhausted, the method 500 proceeds to a conclusionary step 526 and may terminate. In step 526, the control system 210 may stop providing power to the motor 208 and the pump system 42 may stop operating so that an operator may align the control selector switch 214 to a correct operating status. In embodiments, the control system 210 may display information to the operator that operation of the pump system 42 has terminated. In one or more embodiments, the control system 210 may command the main breaker (not shown) to open which will remove medium voltage power from the pump system 42 and send an error message to the operator. After the pump system 42 has been shut down, the operator may make any necessary adjustment to fix the relayed discrepancy.

An embodiment of the present disclosure is a method, comprising: measuring the speed of a motor of the pumping system, wherein the pumping system further comprises a first pump and a second pump, wherein a control system is configured to operate the pumping system; determining a timeout period, wherein the timeout period is dependent on the speed of the motor; measuring the speed of the first pump, the second pump, or both, wherein there is a hall-effect sensor coupled to each of the first pump and the second pump; determining a designated operating condition of the pumping system; and determining if the first pump, the second pump, or both are enabled to operate in relation to the designated operating condition.

In one or more embodiments described in the preceding paragraph, wherein both the first pump and the second pump are coupled to the motor. In one or more embodiments described above, wherein one of the first pump and the second pump is enabled to operate in relation to the designated operating condition and the remaining one is not enabled to operate in relation to the designated operating condition. In one or more embodiments described above, wherein the first pump is decoupled from the motor and the second pump is coupled to the motor. In one or more embodiments described above, wherein both the first pump and the second pump are enabled to operate in relation to the designated operating condition, or wherein the first pump is enabled to operate and the second pump is not enabled to operate in relation to the designated operating condition. In one or more embodiments described above, wherein the first pump is coupled to the motor and the second pump is decoupled from the motor. In one or more embodiments described above, wherein both the first pump and the second pump are enabled to operate in relation to the designated operating condition, or wherein the second pump is enabled to operate and the first pump is not enabled to operate in relation to the designated operating condition. In one or more embodiments described above, further comprising of decrementing measured time from the timeout period. In one or more embodiments described above, further comprising of removing power from the pumping system to terminate operation of the motor. In one or more embodiments described above, further comprising of adjusting a control selector switch to change the designated operating condition.

Another embodiment of the present disclosure is a pumping system, comprising: a motor; a first pump; a second pump; a control system; and a control selector switch; wherein the first pump and the second pump are removably coupled to the motor; wherein the control system is coupled to the motor, the first pump, and the second pump, wherein the control system is configured to operate and provide power to the pumping system, wherein the control selector switch is coupled to the control system, wherein the control selector switch is configured to designate an operating condition of the pumping system.

In one or more embodiments described in the preceding paragraph, further comprising a hall-effect sensor coupled to the first pump and a separate hall-effect sensor coupled to the second pump, wherein both hall-effect sensors are configured to measure the speed of the first pump and the second pump. In one or more embodiments described above, wherein the hall-effect sensors are communicatively coupled to the control system. In one or more embodiments described above, further comprising a decoupler coupled to the first pump and a separate decoupler coupled to the second pump.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method for monitoring a pumping system, comprising:

measuring the speed of a motor of the pumping system, wherein the pumping system further comprises a first pump and a second pump, wherein both the first pump and the second pump are selectively coupled to the motor, wherein one of the first pump and the second pump is enabled to operate in relation to the designated operating condition and the remaining one is not enabled to operate in relation to the designated operating condition, wherein a control system is configured to operate the pumping system, and wherein the speed of the motor is measured by the control system;

determining a timeout period, wherein the timeout period is dependent on the speed of the motor;

measuring the speed of the first pump, the second pump, or both, wherein the speed of each of the pumps is measured by a hall-effect sensor coupled to each of the first pump and the second pump;

determining a designated operating condition of the pumping system; and determining if the first pump, the second pump, or both are enabled to operate in relation to the designated operating condition.

2. The method of claim 1, further comprising of decrementing measured time from the timeout period.

3. The method of claim 2, further comprising of removing power from the pumping system to terminate operation of the motor.

4. The method of claim 3, further comprising of adjusting a control selector switch to change the designated operating condition.

5. The method of claim 1, wherein the first pump is coupled to the motor and the second pump is decoupled from the motor.

6. The method of claim 1, wherein both the first pump and the second pump are enabled to operate in relation to the designated operating condition, or wherein the second pump is enabled to operate and the first pump is not enabled to operate in relation to the designated operating condition.

7. The method of claim 6, further comprising of decrementing measured time from the timeout period.

8. The method of claim 7, further comprising of removing power from the pumping system to terminate operation of the motor.

9. The method of claim 8, further comprising of adjusting a control selector switch to change the designated operating condition.

10. The method of claim 1, wherein the first pump is decoupled from the motor and the second pump is coupled to the motor.

11. The method of claim 1, wherein both the first pump and the second pump are enabled to operate in relation to the designated operating condition, or wherein the first pump is enabled to operate and the second pump is not enabled to operate in relation to the designated operating condition.

12. The method of claim 11, further comprising of decrementing measured time from the timeout period.

13. The method of claim 12, further comprising of removing power from the pumping system to terminate operation of the motor.

14. The method of claim 13, further comprising of adjusting a control selector switch to change the designated operating condition.

15. A method for monitoring a pumping system, comprising:

measuring the speed of a motor of the pumping system, wherein the pumping system further comprises a first pump and a second pump selectively coupled to the motor in response to a designated operating condition, wherein a control system is configured to operate the pumping system, and wherein the speed of the motor is measured by the control system;

determining a timeout period comprising the speed of the motor;

measuring the speed of the first pump, the second pump, or both, wherein the speed of each of the pumps is measured by a hall-effect sensor coupled to each of the first pump and the second pump;

determining a designated operating condition of the pumping system; and determining if the first pump, the second pump, or both are enabled to operate in relation to the designated operating condition.

16. The method of claim 15, wherein one of the first pump and the second pump is enabled to operate in relation to the designated operating condition and the remaining one is not enabled to operate in relation to the designated operating condition.

17. The method of claim 15, wherein the first pump is coupled to the motor and the second pump is decoupled from the motor.

18. The method of claim 15, wherein both the first pump and the second pump are enabled to operate in relation to the designated operating condition, or wherein the second pump is enabled to operate and the first pump is not enabled to operate in relation to the designated operating condition.

* * * * *